United States Patent [19]

Tsay

[11] Patent Number: 4,964,024

[45] Date of Patent: Oct. 16, 1990

[54] LIGHT EMITTING WRITING APPARATUS

[76] Inventor: Huang-Hsien Tsay, 9, Lane 1042, Wu-Kuang Rd. Wu-Jih Shiang, Taichung Shien, Taiwan

[21] Appl. No.: 470,587

[22] Filed: Jan. 26, 1990

[51] Int. Cl.[5] ..... B43K 29/10

[52] U.S. Cl. ..... 362/118; 362/32

[58] Field of Search ..... 362/32, 109, 118, 157, 362/205, 208, 253

[56] References Cited

U.S. PATENT DOCUMENTS 4,016,414 4/1977 Browning et al. ..... 362/118

4,168,521 9/1979 Bajusz ..... 362/118

4,518,274 5/1985 Hanggi ..... 362/118 X 4,890,204 12/1989 Cin et al. ..... 362/118

*Primary Examiner*—Stephen F. Husar

*Attorney, Agent, or Firm*—Bacon & Thomas

[57] ABSTRACT

A light emitting writing apparatus, which includes a cylinder in the pen-holder thereof for holding a dry battery, a holder plate in the pen-holder thereof for holding a lamp bulb and a plurality of writing elements, and a button slider positioned in a through-hole on the pen-holder thereof for controlling the connection of the positive end of the dry battery to its negative end through the lamp bulb so as to turn on the lamp bulb to produce light.

4 Claims, 3 Drawing Sheets

LIGHT EMITTING WRITING APPARATUS

BACKGROUND OF THE INVENTION

The present invention relates to writing apparatus and more particularly to a light emitting pen which produces light to help writing under dark condition.

Illumination is very important for smooth writing and for the protection of one's eyes during writing. Conventionally, a lighting source is separately prepared to facilitate smooth writing. There is a kind of writing apparatus which has a self-provided lighting source to produce light during writing. It is merely a combination of a pen and a hand-lamp which occupies much space and not convenient for the holding of the hand. The present invention is an improvement on a structure of light emitting pen.

An object of the present invention is to provide a light emitting writing apparatus which does not occupy much space.

Another object of the present invention is to provide a light emitting writing apparatus in which the light emitting source is positioned in the central axis of the penhodler thereof, permitting the arrangement of a plurality of writing elements therein.

DETAILED DESCRIPTION OF THE PREFERRED EMBODIMENTS

Figure 1:
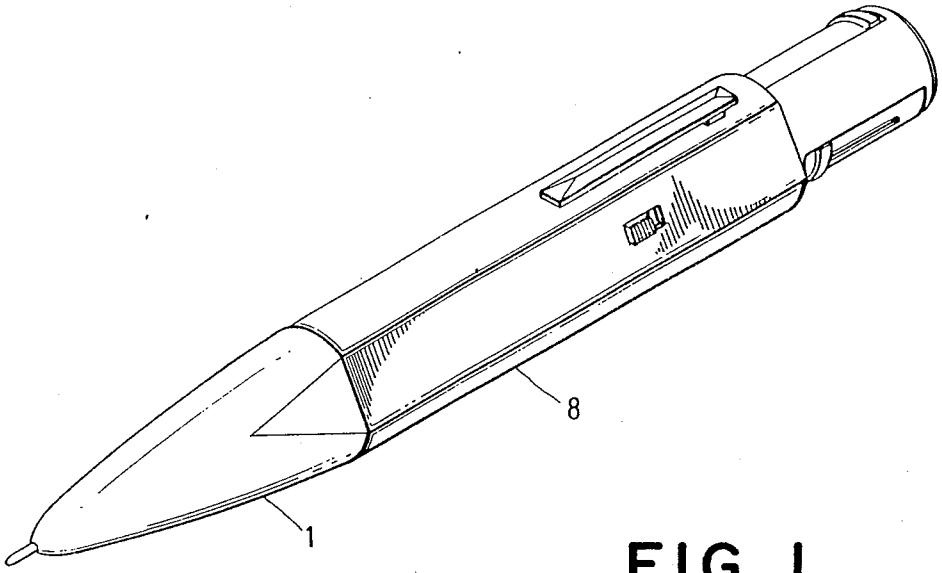
FIG. 1 is a perspective view of a light emitting writing apparatus embodying the present invention.
Figure 2:
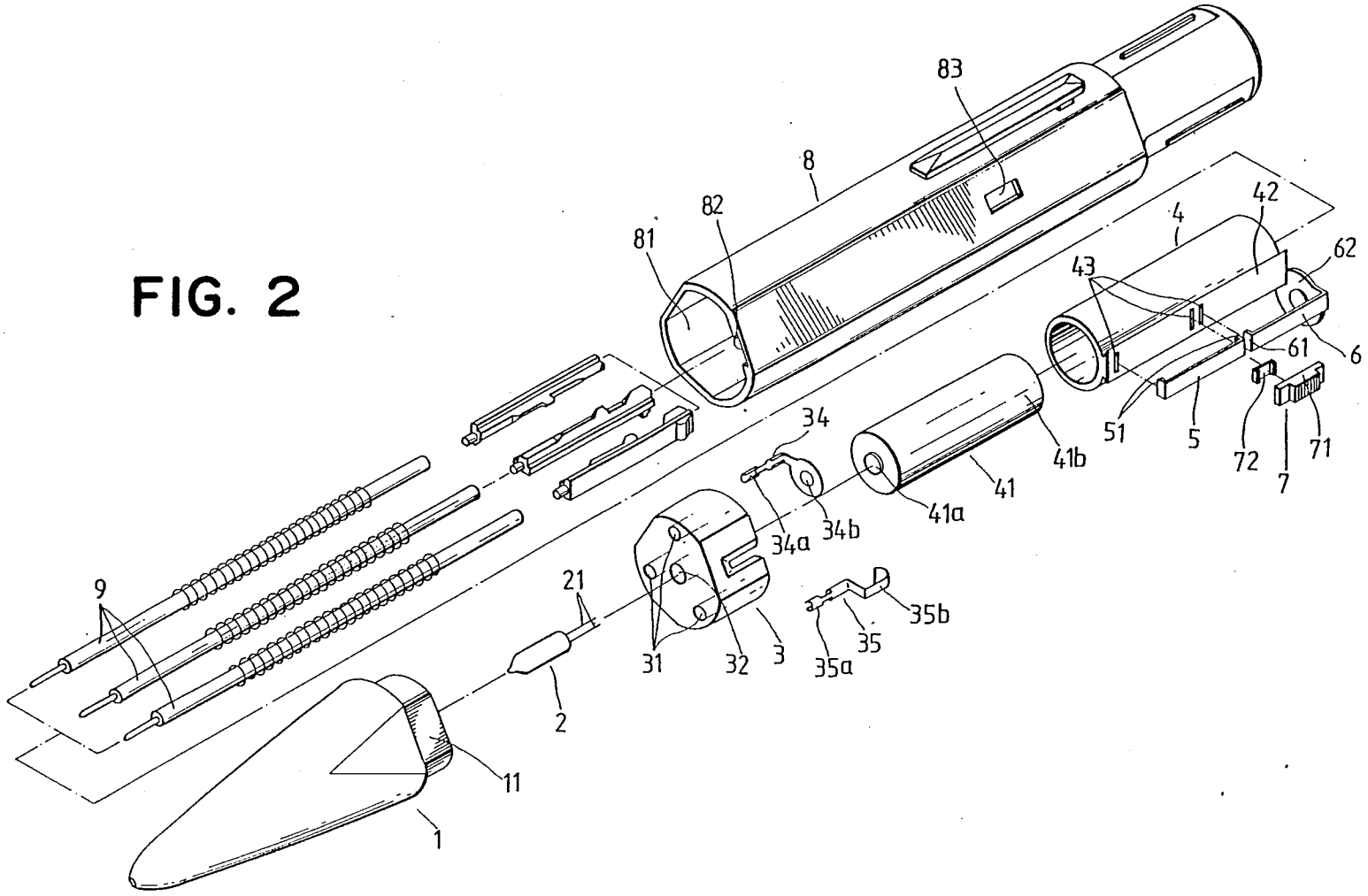
FIG. 2 is a perspective exploded view of the light emitting writing apparatus of FIG. 1.

Referring to FIG. 2, there is illustrated a light emitting pen in accordance with the present invention and generally comprised of a front socket 1 and a pen-holder 8. The pen-holder 8 is a hollow cylinder having an opening 81 at its one end. The front socket 1 has a hollow, conical structure comprising a connecting end 11 in shape suitable for fastening in the opening 81 of the pen-holder 8 to protect the component parts which are received in the pen-holder 8 from breaking away.

A cylinder 4 is set in the pen-holder 8 for receiving therein a dry battery 41, which comprises a raised longitudinal strip 42 set to slide along a groove 82 on the inner wall surface of the pen-holder 8. The raised longitudinal strip 42 of the cylinder 4 has thereon a plurality of notches 43 for the positioning therein of the leg portions 51, 61 of two conductive leaves 5, 6. When the two conductive leaves, or the first and second conductive leaves 5, 6 are respectively secured to the cylinder 4, they are not in contact with each other. The second conductive leaf 6 comprises an end 62 extending to the rear end of the cylinder 4 to constantly contact one end **41*b* (in the drawing, it is a negative end) of the dry battery 41**.

An electrically insulative button slider 7 which comprises an unitary raised portion 71 in the middle and has an electrically conductive plate 72 secured thereto on its bottom is received in the pen-holder 8 to alternatively press on the two conductive leaves 5, 6, with its unitary raised portion 71 protrude beyond a through-hole 83 on the pen-holder 8. The through-hole 83 of the pen-holder 8 has a length longer than the raised portion 71. Thus, the button slider 7 can be pushed through its raised portion 71 to move upward and downward within the through-hole 83 so as serve as a contact switch to control the connection and disconnection of the two conductive leaves 5, 6.

Figure 3:
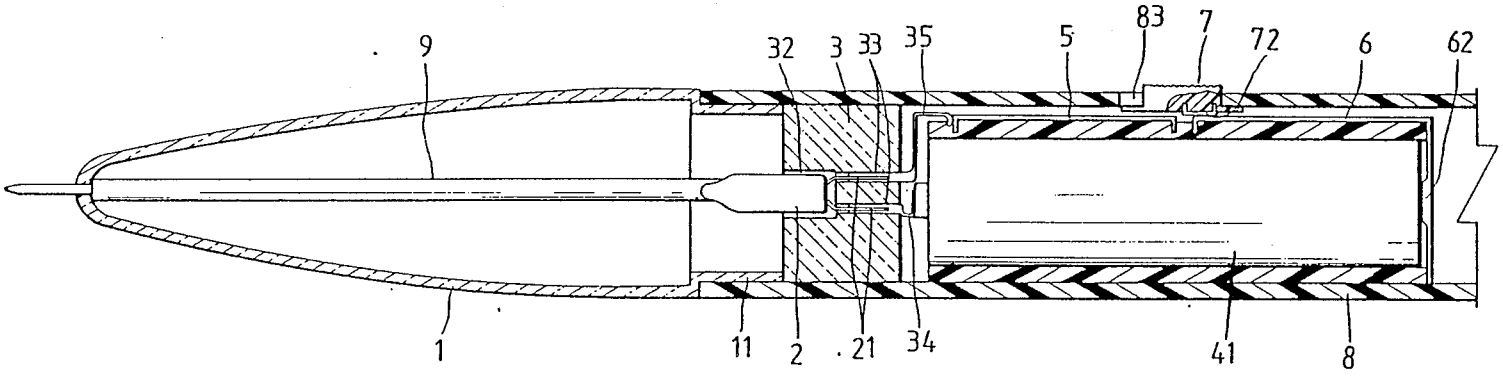
FIG. 3 is a sectional elevation of the light emitting writing apparatus of FIG. 1.

Please refer to FIG. 3 and see FIG. 2 again. A holder plate 3 is received in the pen-holder 8 and set between the connecting end 11 of the front socket 1 and the cylinder 4, which comprises a plurality of through holes 31 along axial direction and arranged in parallel with one another for the fastening therein of equal number of writing elements 9 (T-ball jotters or inner reservoirs with writing ink; in the present embodiment, there are 3 writing elements being used), and a recess hole 32 in the center having two wire holes 33 axially piercing therethrough for the insertion therethrough of the hollow cylindrical front ends **34*a*, 35*a* of two connecting members 34, 35 respectively. A lamp bulb 2 is set in the recess hole 32 with its two conductors 21 inserted in the two wire holes 33 to respectively connect to the two hollow cylindrical front ends 34*a*, 35*a*. The first connecting member 34 has a rear end 34*b* disposed at the back center of the holder plate 3 to constantly contact the other end 41*a* of the dry battery 41 (in the drawing, it indicates the positive end). The second connecting member 35 has a rear end 35*b* stopped against the first conductive leaf 5 on the raised strip 42 of the cylinder 4. Therefore, the positive end 41*a* of the dry battery 41 is connected through the first connecting member 34, the conductors 21 of the lamp bulb 2, the second connecting member 35, the first conductive leaf 5, the conductive plate 72, the second conductive leaf 6 to the negative end 41*b*** to form an electrically conductive circuit.

When the cylinder 4 is moved to slide to the bottom end of the groove 82 by means of its raised strip 42 to firmly position therein, and the connecting end 11 of the front socket 1 is secured in the opening 81 of the pen-holder 8, the range between the front end of the cylinder 4 and the connecting end 11 becomes equal to the thickness of the holder plate 3, such that the holder plate 3 can be firmly squeezed in between the cylinder 4 and the connecting end 11 of the front socket 1 permitting the second connecting member 35 to contact the first conductive leaf 5.

As an alternate form of the present invention, the holder plate 3 can be secured in the pen-holder 8 by means of adhesive glue; the connection of the connecting end 11 of the front socket 1 in the opening 81 of the pen-holder 8 can be made by means of screw joint. Any modification on binding shall permit the range between the front end of the cylinder 4 and the connecting end 11 to be equal to the thickness of the holder plate 3 so that the holder plate 3 can be firmly retained in the pen-holder 8.

When the circuit is electrically connected to turn on the lamp bulb 2, the light which is produced by the lamp bulb 2 projects through the front end of the front socket 1 to provide illumination during writing. For penetration of light, the front socket 1 and the holder plate 3 shall be made of transparent or semi-transparent material.

What is claimed:

1. A light emitting writing apparatus, including:

a pen-holder being a hollow cylinder having an opening at its one end, a longitudinal groove on its inner wall surface, and a through-hole through its sidewall;

a front socket having a hollow, conical structure comprising a connecting end fastening in the opening of said pen-holder;

a cylinder received in said pen-holder to slide along said groove and comprising a raised strip having two conductive leaves disconnectedly mounted thereon;

a button slider being received in said pen-holder and having a raised portion set to protrude beyond the through-hole of said pen-holder and a conductive plate on its bottom alternatively pressing on the two conductive leaves of said cylinder, said button slider being pushed to slide in the through-hole of said pen-holder so as to connect or disconnect said two conductive leaves;

a dry battery received in said cylinder;

a holder plate received in said pen-holder and comprising a plurality of through-holes for the positioning therein of a plurality of writing elements, and a recess hole having two wire holes penetrating therethrough;

a lamp bulb set in the recess hole of said holder plate with its two conductors respectively received in the two wire holes of said recess;

two connecting members respectively inserted in the two wire holes of said recess to connect to the two conductors of said lamp bulb;

wherein one of said connecting members is connected with the positive end of said dry battery and the other connecting member is connected with one of said two conductive leaves while the other conductive leaf is connected with the negative end of said dry battery; and wherein the moving of said button slider in the through-hole of said pen-holder controls the connection of the negative end of said battery to its positive end through said lamp bulb so as to turn on said lamp bulb to produce light.

2. A light emitting writing apparatus as claimed in claim 1, wherein said cylinder is moved to slide to the bottom end of the groove of said pen-holder by means of its raised strip to become firmly positioned therein, and the connecting end of said front socket is secured in the opening of said pen-holder permitting the range between the front end of said cylinder and the connecting end to be equal to the thickness of said holder plate.

3. A light emitting writing apparatus as claimed in claim 1, wherein said front socket and said holder plate are made of transparent or semi-transparent material suitable for the penetration therethrough of light.

4. A light emitting writing apparatus as claimed in claim 1, wherein the shape of the connecting end of said front socket is same as the shape of the opening of said pen-holder.

* * * * *